United States Patent [19]

Gordon

[11] 4,168,061

[45] Sep. 18, 1979

[54] ATHLETE'S LONG JUMP PIT

[76] Inventor: Donald W. Gordon, 2718 Standish, Anaheim, Calif. 92806

[21] Appl. No.: 850,746

[22] Filed: Nov. 11, 1977

Related U.S. Application Data

[63] Continuation of Ser. No. 648,214, Jan. 12, 1976, abandoned.

[51] Int. Cl.[2] ..... A63B 5/18

[52] U.S. Cl. ..... 272/101; D21/199

[58] Field of Search ..... 272/101, 109, 93, 1 R, 272/100; 5/344, 336, 354, 320, 334 C; D34/5 K

[56] References Cited

U.S. PATENT DOCUMENTS

| | | | |
|---|---|---|---|
| 1,897,521 | 2/1933 | La Garde | 5/320 |
| 2,652,966 | 9/1953 | Griswold | 272/109 X |
| 3,242,509 | 3/1966 | Nissen | 272/109 |
| 3,262,134 | 7/1966 | Bramble | 272/109 |
| 3,369,808 | 2/1968 | Sconce | 272/101 X |
| 3,513,491 | 5/1970 | Gordon | 272/101 |
| 3,682,476 | 8/1972 | Kempson et al. | 272/100 |
| 3,879,777 | 4/1975 | Walker | 5/354 |
| 3,892,401 | 7/1975 | Sorrenson | 272/101 |
| 3,892,402 | 7/1975 | Montour | 272/101 |

*Primary Examiner*—Richard J. Johnson

*Attorney, Agent, or Firm*—Knobbe, Martens, Olson, Hubbard & Bear

[57] ABSTRACT

A portable long jump pit is disclosed which may be installed in a gymnasium, on top of a regular playing surface and used in conjunction with an elevated runway, or outdoors recessed into the ground surface such that the top is level with a runway. The pit includes a foam cushioning member which is held stationary relative the runway and a separate fabric cover over the cushioning member which is held in place by elastic cords. When the long jumper lands on this fabric member, it moves laterally on the top of the cushioning member, the elastic supports and the cushioning member absorbing the lateral momentum of the athlete. An optional enlarged landing pillow or bumper is placed at the end of the pit opposite the runway to protect the athlete from running beyond the pit surface after his jump. Numerous marking systems are disclosed for recording the landing position of the athlete.

30 Claims, 8 Drawing Figures

FIG. 1.
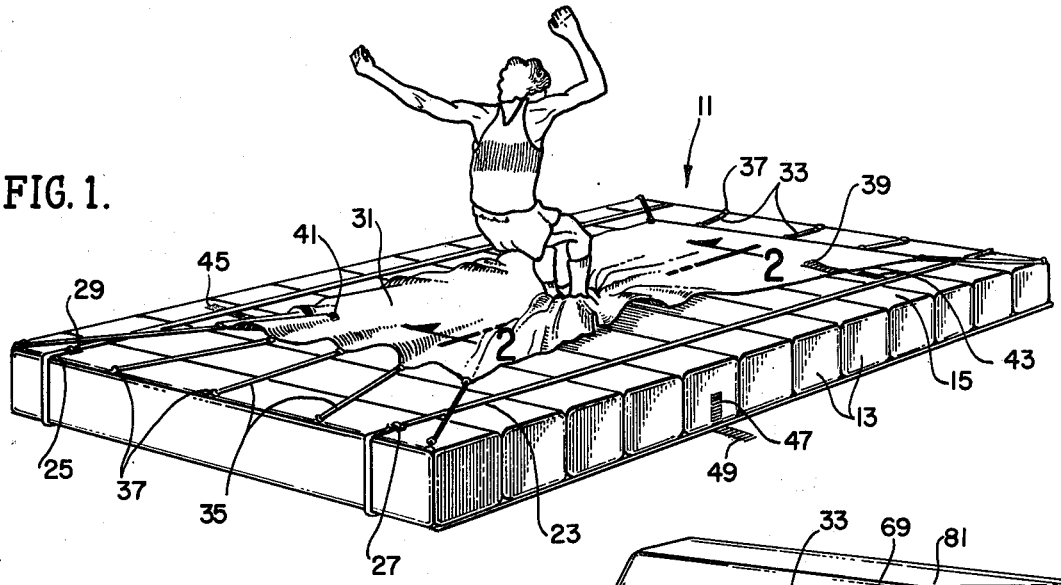
FIG. 3.
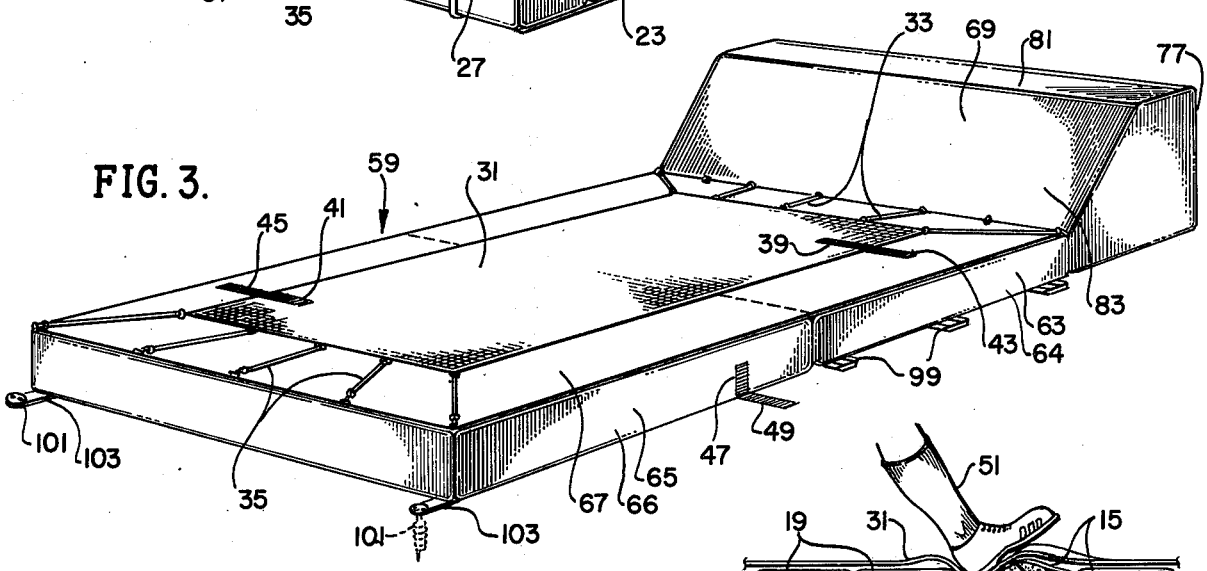
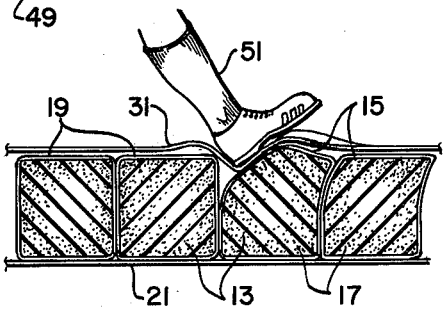
FIG. 2.
FIG. 4.
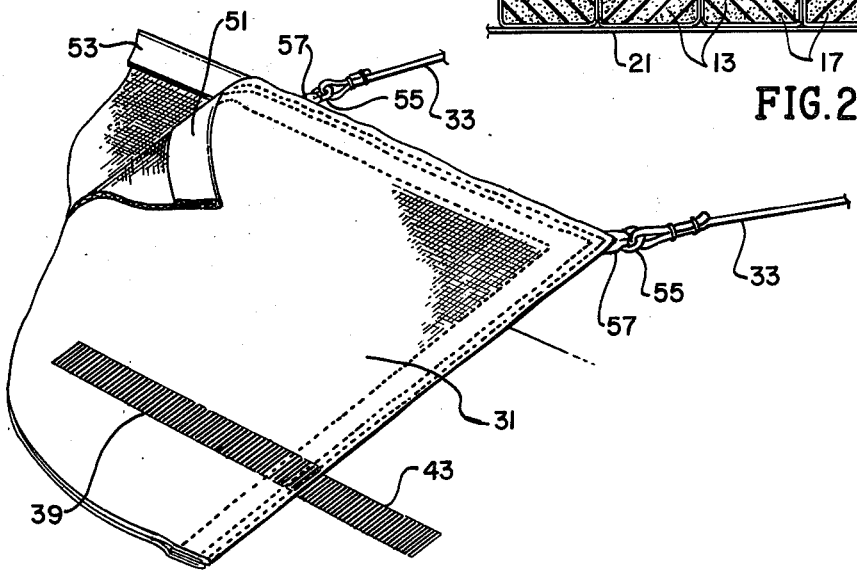

ATHLETE'S LONG JUMP PIT

This is a continuation, of application Ser. No. 648,214, filed 1/12/76, now abandoned.

BACKGROUND OF THE INVENTION

The present invention relates to athlete's landing pits and, more particularly, to a portable landing pit which is adapted for use by long jumpers and triple jumpers.

A variety of athlete's landing pits have been used in the prior art for cushioning the vertical momentum of high jumpers and pole-vaulters. Such pits typically take the form of a thick foam cushion covered by fabric layers and placed behind a clearance bar used by the jumper. These pits have gained wide acceptance particularly because of their portability and the ease of construction and disassembly, particularly when used for indoor track meets. They have therefore, to a great extent, replaced the older sawdust-filled high jump pits, even for use outdoors.

At present, however, no satisfactory portable landing pit has been devised for use by distance jumpers as opposed to height jumpers. Thus, for long jumpers and triple jumpers, it is still necessary to build a framework in which sand, or a similar material, is maintained as a landing and marking surface. Thus, it is common in such athletic endeavors to smooth the upper surface of a sand layer and to have the athlete jump thereon, the depression made in the smooth upper sand surface used to measure the distance of the jump. In addition, the weight of the sand itself is sufficient to absorb the lateral momentum of the athlete to protect the athlete from injury.

Such sand pits produce a number of difficulties. Initially, it will be recognized that the sand material is extremely heavy and is used as a bulk product, so that it is extremely difficult to assemble, disassemble, and store such pits. Therefore, they have typically been installed as a permanent outdoor facility, the sand generally being placed in a shallow excavation in the ground so that the runway used by the jumper can be at ground level. Such pits, of course, have particular drainage problems when used outdoors.

Even more inconvenient is the construction of sand pits indoors. Such pits are commonly positioned adjacent an elevated runway and include elevated side walls for confining a layer of sand. The side walls themselves, generally being rigid wood members, are a hazard to the jumper. In addition, during indoor track meets the runway and pit combination is usually quite long and therefore extends adjacent a track surface. The sand which is sprayed from the pit surface during a jump is therefore often hazardous to track runners. In addition, long jumpers often complete their jump by running off the end of the pit which may interfere with runners on an adjacent track.

Because of the hazard to track runners and because of the substantial expense and difficulty of assembling a sand pit, there is substantial concern that the long jump and triple jump will be discontinued in indoor track meets. This fear is increased by the fact that the sand pits require substantial maintenance during a track meet, often requiring as many as ten attendants for properly smoothing the sand surface between jumps and measuring jump distances, so that the overall cost of providing a long jump at an indoor track meet is excessive. Furthermore, the length of time required to smooth the sand surface and prepare it for each jump is excessive when a sand pit is used, so that these track events become somewhat boring to the audience.

SUMMARY OF THE INVENTION

The present invention alleviates these difficulties associated with prior art long jump pits by providing a portable landing cushion which in many respects operates in a manner quite similar to a sand pit in cushioning the momentum of the runner while avoiding the disadvantages of sand pits. The pits described herein are referred to as long jump pits, but it will be understood that the pits are quite suitable for use in other competitive sports in which the athlete lands with a predominant horizontal velocity vector as opposed to the predominant vertical velocity victor present in a high jump or pole-vault contest. These pits may also be used in other environments as safety devices, etc. wherever an object or person contacts the surface having a predominant, generally horizontal velocity vector. Basically, the invention comprises a foam pad which may be segmented into two or more pieces for folding or carrying or may be in the form of a multiplicity of logs formed of polymer foam, in either case the foam being covered by fabric. Across the foam pad is stretched a landing pad held in place by straps. The landing pad may be formed of one or two or more layers of fabric and is adapted to slide over the fabric which encloses the foam padding. In a preferred embodiment, a measuring line is provided on both the landing pit and the fabric covering so as to permit return of the landing pad to its precise position for measurement of the length of a jump. The invention additionally contemplates a bumper pad for catching the competitor and bringing him to a safe stop within the area of competition. The use of rigid plywood boards or the like in connection with various structures in the foam pad and other structures to provide rigidity and maintain the pit in proper position is also contemplated within the scope of the invention. Many other variations and modifications, only some of which are discussed in detail hereinafter, may be made to this invention without departing from the concept thereof.

The fabric landing pad is generally held in place by elastic strap members which permit the landing pad to move relative to the foam pad but is also helpful in absorbing some of the lateral momentum of the jumper.

The foam pads which have been found to be most useful in this invention are generally described as polyurethane-ether foams which are formed by the reaction of an isocyanate, for example, toluene diisocyanate and an ether-type polyol such as a trihydroxy polyol formed by the reaction of propylene oxide and glycerine or propylene oxide and ethylene oxide. Suitable catalysts such as stannis oxalate or other organo-tin catalysts along with tertiary amine catalysts and auxillary blowing agents, such as low-boiling fluorocarbons, and suitable stabilizers are conventionally used. Foams of this type are marketed by United Foam Corporation under their formulation designation No. 2064 and have a density of about 2.25 pounds per cubic foot. The processing conditions and materials for forming foams of this type are well known in the prior art, see for example, the article entitled "Urethane Polymers" in Volume 21, at page 56, of the Kirk-Othmer Encyclopedia of Chemical Technology, 2nd Edition, Wiley-Interscience, 1970, and extensive discussions in the chemical literature such as the Modern Plastics Encyclopedia for the periods since 1955. It is to be clearly understood, however, that this is the preferred type of foam material but is not an essential type for use in a satisfactory device of the type described and claimed herein. The polyurethane-ether foam of the type described is extremely resistant to break up and has an excellent memory with a slow recovery. It has a limp, wet and mush feel and returns relatively slowly to its original configuration so as not to have a bouncy feel which is experienced with some other types of elastomeric foams. In general, any resilient foam which has a good memory, that is, it returns to its original configuration following impact, and a comparatively slow recovery, that is, more than a few tenths of a second, may be quite satisfactorily used in this invention. Other polyurethane foam formulations than those described, as well as other types of foams, may be used.

It has been found helpful to form at least a part of the fabric covering for the foam pads as an air permeable material, that is, material which breathes air in and out upon impact and recovery. One type of breathable fabric has been found to be extremely useful in devices of this type where high resistance to abrasion, scuffing and cutting by cleats and the like is necessary. A fabric made of nylon fibers coated with polyvinyl chloride has been found to be very breathable and also resistant to destruction during use. This type of fabric is widely used in athletic pit devices in the industry. Of course, other types of breathable material, such as conventional synthetic polymer fiber fabrics, canvas fabrics, etc., may be used, although a shorter life may be expected.

The preferred method described for precisely measuring the landing position of the athlete to determine the winner of competition is the use of a chalk box in which the athlete steps just prior to his jump. The heels of the athlete's shoes will become covered with chalk and, when he lands on the upper fabric cover, his heels will therefore leave chalk marks on this cover which may be used for measurement purposes. Alternatively, a paper sheet is disclosed which is attached to the upper fabric cover and which will tear when the jumper impacts the pit, leaving a permanent mark showing the jumper's landing position. As a further alternative, a photo-optical system using plural photocells is disclosed, the system providing plural light beams across the surface of the pit which, when interrupted, mark the location of the jumper's impact on the landing pit.

These and other features of the present invention are best understood through a reference to the drawings, in which:

FIG. 1 is a perspective view of a landing pit constructed in accordance with the present invention and shown during use;

FIG. 2 is a partial sectional view taken along lines 2—2 of FIG. 1 showing the operation of the landing pit of FIG. 1 during a jumper's impact;

FIG. 3 shows an alternate embodiment of the landing pit of the present invention in perspective, the landing pit in this case additionally including a bumper cushion for receiving the jumper at the termination of his jump;

FIG. 4 is a partial perspective view showing the upper fabric layer of the landing pits of FIGS. 1 and 3, including the details of construction and fastening thereof;

DETAILED DESCRIPTION OF THE PREFERRED EMBODIMENT

Figure 5:
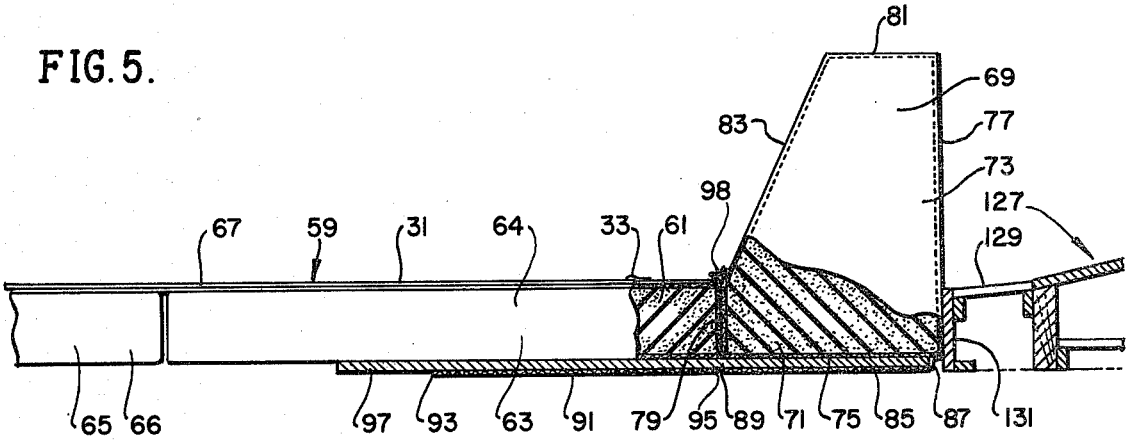
FIG. 5 is a side elevation view of the landing pit of FIG. 3, partially in section, showing the details of construction of the cushioning pad and landing bumper.

Referring initially to FIGS. 1 and 2, the initial embodiment pit 11 of the present invention includes plural, fabric covered, elongate foam logs 13 which are juxtaposed to provide a relatively planar upper surface 15. As shown particularly in FIG. 2, each of these logs includes an elongate internal foam block member 17 which is generally square in cross section and is preferably formed of polyurethane-ether foams formed by the reactions which are described in detail above. Each of these foam blocks 17 is in turn individually covered by a fabric enclosure 19 surrounding the top, bottom and two sides, as well as the ends of the individual blocks 17. In order to assure the juxtaposition of the fabric covered foam logs 13, it is advantageous to include a bottom fabric layer 21 as a single fabric layer sewn to each of the foam logs 13. Thus, each of the foam blocks 17 is completely enclosed, and the fabric layer 21 forms an additional bottom protective layer for the fabric layer 19, sewn to the bottom layer 21. The construction of the fabric covered blocks 13 using the common bottom cover 21 facilitates folding the pit 11 in a variety of locations for transportation and storage, and additionally maintains the juxtaposed position of the logs 13. An additional precaution which may be taken for this latter purpose is the use of a pair of straps 23 and 25 surrounding the pit 11 in a longitudinal direction and cinched end-to-end by a pair of buckles 27 and 29, respectively. The straps 23, 25 serve to hold the tops of the individual logs 13 together to assure a relatively planar upper surface 15. The straps 23, 25 are, however, preferably positioned adjacent the ends of the individual foam logs 13 so that, upon impact from a jumper, separation of the logs 13 is permitted, as will be explained in more detail below.

The fabric bottom cover 21 is preferably made of moisture impervious material so that, if the pit 11 is placed outside on the ground, the foam blocks 17 are protected from moisture. The upper cover material 19, however, is advantageously formed of breather material, the details of which are described above, in order to assure that the individual logs 13 will not act as air-filled balloons which would otherwise interfere with the cushioning properties of the foam 17. In addition, the breather material 19 may be made extremely rugged in order to prohibit abrasion of the foam blocks 17 by the cleats used by a jumper.

As particularly shown in FIG. 1, at least a portion of the upper surface 15 of the landing pit 11 is covered by a fabric layer 31 which is held in place on the planar surface 15 by plural straps. A first group of straps 33 are preferably formed as nonelastic nylon web strap members, these straps 33 being positioned at the end of the pit 11 away from the athlete's runway. A second group of straps 35 are attached to the fabric sheet 31 at the end adjacent the athlete's runway and are formed of elastic cord material. Each of the straps 33 and 35 are attached to rings 37 sewn onto the upper covering 19 of the outermost foam blocks 13. At the opposite end, the straps 33, 35 are preferably sewn onto the fabric cover 31 or permanently attached to hooks or rings which are, in turn, sewn onto the fabric cover 31.

The use of the resilient straps 35 serves two purposes. First, the resilience of these straps 35 draws the cover 31 tightly over the upper planar surface 15. More importantly, the resilience in the straps 35 permits the upper cover 31 to slide along the upper planar surface 15 during an athlete's landing, as shown in FIG. 1. The stretching of the straps 35 therefore serves to absorb a portion of the athlete's horizontal momentum. While the straps 33 could also be made of elastic material, it has been found preferable, as stated above, to form these members of nonelastic material so that the upper fabric cover 31 will return to a predetermined position after each jump, drawn to this position by the resilient straps 35 but restrained by the straps 33. In order to assure the accurate positioning of the upper fabric cover 31, a pair of marks 39 and 41 are permanently applied to the upper surface of the fabric layer 31. Corresponding marks 43 and 45 are imprinted on the upper planar surface 15 of the logs 13. Before and after each jump, the marks 39 and 41 are aligned with the marks 43 and 45, respectively, to assure that the upper fabric cover 31 always returns to its initial position. A similar mark 47 is advantageously applied along one side of one of the logs 13 and is used to align the entire landing pit 11 with a mark 49 on the ground or gymnasium surface on which the landing pit 11 is installed. A similar pair of marks (not shown) is advantageously positioned on the opposite side of the landing pit 11.

Referring now specifically to FIG. 4, the construction details of the upper fabric cover 31 and its attachment will be described. This fabric cover 31 preferably includes a top cover sheet 51 formed by breather material, such as that described in detail above, and sewn to a lower covering layer 53 which is preferably formed of a hard surfaced plastic material such as polyethylene. The layer 53 is intended to operate as a lubricating layer between the breather material 51 and the breather material 19 forming the upper fabric covering for the foam logs 13. It is therefore selected as a material which will slide easily on the breather material 19. As shown in FIG. 4, the nonelastic straps 33 may be passed through rings 55 attached to web members 57 which are in turn sewn between the fabric layers 51 and 53. The straps 33 may be returned on themselves after passing through the rings 55 and bound in place permanently. As previously described, the remaining end of the straps 33 may be similarly attached to the upper covering 19 of the foam blocks 13, and a similar attachment arrangement may be used for securing the resilient straps 35 to the fabric cover 31 and pit 11.

In using the landing pit of FIGS. 1, 2 and 3, the pit 11 is placed adjacent the end of an elevated runway, this runway typically having a height which is equal to the height of the foam blocks 13. The runway, as is typical in a long jump or triple jump configuration, will have a toe block which will determine the initial jumping point for the athlete. The athlete will typically begin his running approach toward the pit 11 a substantial distance behind this toe board. A chalk box is set in the runway surface just short of the toe board. The chalk material will adhere to the bottom of the athlete's feet so that, after he has run and jumped onto the pit 11, the chalk on his feet will leave marks at the point of landing on the upper fabric cover 31. Thus, if the marks 49 have been set up a predetermined distance from this toe board, if the marks 47 are aligned with the marks 49, and if the marks 39 and 41 are aligned with the marks 43 and 45, respectively, the chalk marks on the fabric cover 31 left by the athlete's feet will serve as a measurement point for determining the length of the athlete's jump. After the athlete has completed his jump, the marks 47, 49, 39, 41, 43 and 45 are again aligned and a measurement is made between the toe board and the chalk mark on the fabric cover 31 closest to the toe board, this measurement being an accurate determination of the jump distance. It is therefore important that each of the respective alignment marks be aligned before and after each jump.

Referring now specifically to FIG. 2, the operation of each of the foam blocks 13 in response to an athlete's impact will be described. When the athlete lands, his foot 51 will typically land on the upper fabric cover 31 at the top of one of the individual blocks 13. His cleats will typically become attached to the upper fabric cover 31 but the lower lubrication layer 53 will permit the fabric layer 31 to begin sliding in the direction of the athlete's jump. This sliding will continue until the athlete's feet 51 slide into one of the interstices between adjacent foam blocks 13. The athlete's feet, at this point, will engage the upper corner of one of the foam blocks 13 and this foam block, as shown in FIG. 2, will become deformed, absorbing the lateral and vertical momentum of the jumper. The use of the particular foam material described in detail above for the blocks 113, that is, material which has a limp, wet and mush feel, provides a reaction to the athlete's jump which is quite similar to the sand into which the athlete is accustomed to jumping. Furthermore, this type of material provides substantial protection to the athlete to avoid injury, and the relatively heavy weight of the material permits the foam blocks 13 to absorb the substantial lateral momentum of the athlete.

Referring now to FIGS. 3, 4 and 5, an alternate construction of the landing pit of the present invention will be described. This pit 59 utilizes an identical upper fabric cover 31 as that shown in FIG. 3 and used in the embodiment of FIGS. 1 and 2. This upper fabric cover 31 is attached, as in the previous embodiment, by plural nonelastic strap member 33 and plural elastic strap members 35 to the pit structure. Similarly, alignment marks 39, 41, 43 and 45, as well as alignment marks 47 and 49, are used to align this pit structure and the fabric cover 31 to the toe board of the athlete's runway. In the pit 59, however, rather than using the plural elongate juxtaposed foam blocks 13 of the prior embodiment, two identical large foam pad members, one of which is shown at 61 in FIG. 5, are each enclosed by fabric covers 63 and 65 to form a pair of cushion members 64 and 66. These fabric covers 63, 65 are preferably constructed with the bottoms and sides formed of moisture and air impervious polymer material. The top layer 67, however, is advantageously formed of breather material such as that described in detail above and is advantageously formed as a single sheet of such material covering the tops of each of the cushion members 64 and 66. The use of the pair of cushion members 64 and 66 permits a folding of the pit 59, using the top cover member 67 as a hinge at the intersection of these cushion members 64, 66, to facilitate transportation and storage of the pit 59. Forming the upper fabric cover 67 for both of the cushion members 64, 66 as a single sheet additionally assures that the two cushion members 64 and 66 are maintained in a juxtaposed position at all times. The foam block material 61 used for filling the covers 63 and 65 is preferably the polyurethane-ether foam material described in detail previously in order to provide a feel for the athlete which is not unlike the sand which the athlete is accustomed to using.

The embodiment of FIGS. 3, 4 and 5 additionally includes a large bumper block 69 which, as shown in FIG. 5, preferably includes a solid foam block 71 covered by breather material 73 on all sides. The foam block 71 may be a lighter, more resilient foam than the foam material 61 since it is intended to absorb shocks normal to its surfaces rather than tangential thereto. The block 69 advantageously includes a planar lower surface 75 intersecting at a right angle with an elongate rear surface 77 and a relatively short, normally extending frontal surface 79 which abuts the end of the cushion member 64. Extending from this surface 79 to the top 81 of the bumper 69 is a slightly inclined frontal impact surface 83.

Attached to the lower surface 75 of the bumper 69 is a pocket 85 formed of breather material which is closed at the end 87 adjacent the end 77 of the block 69 and is likewise closed at the sides of the bumper 69. This pocket 85 has an opening 89 facing the cushion member 64. A tubular pocket 91, preferably formed of breather material, is attached to the sides of the cushion member 64 and extends at least part way along the cushion member 64. This pocket 91 is open at both ends 93 and 95. A stiffening member 97, such as a sheet of plywood, is passed through the pocket 91 and positioned into the pocket 85 to rigidly interconnect the end of the cushion member 64 and the bumper 69. Additionally, plural fasteners 98 may be used to interconnect the top rear edge of the cushion member 64 to the bumper 69.

Figure 6:
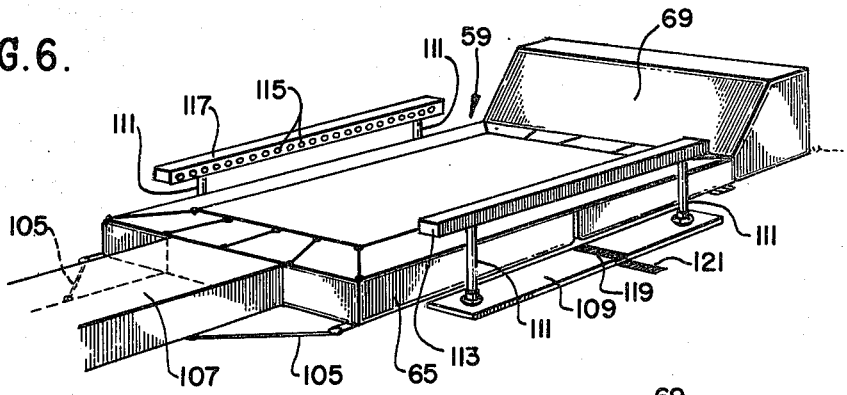
FIG. 6 is a perspective view showing a photo-optical arrangement for determining the distance of an athlete's jump.

Plural handles 99 may be provided on the cushion member 64 to facilitate transportation of the cushion members 64 and 66 when folded on top of one another. A pair of earth-embedding augers 101 may be attached, as by nylon straps 103, to the front cushion member 66 to anchor the entire landing pit structure, including the cushions 64 and 66 and the bumper 69, in position on the ground. Alternatively, as shown in FIG. 6, if the cushion members 64 and 66 are used indoors, a pair of straps 105 may be attached to the front corners of the cushion member 66 and attached to the elevated runway 107 on which the athlete approaches the landing pit 59 to anchor the pit 59 relative the runway 107. Alternatively, the cushions 64 and 66 may be recessed into a surface excavation in the ground when the equipment is used outdoors, so that the excavation holds the cushions 64, 66 and bumber 69 in place.

The landing pit 59 is used in the same fashion as the landing pit 11 of FIGS. 1, 2 and 4, the athlete approaching the pit along a runway 107 and jumping onto the sliding fabric member 31, leaving chalk marks on the member 31 for measuring the distance of the jump. In addition, the bumper 69 assures that the athlete will have a soft landing area as he falls forward after his feet have become embedded in the relatively soft, spongy foam material 61 within the cushion members 64 and 66. As the athlete falls against the cushion members 69 which, as previously mentioned, is less dense than the remaining cushion members 64 and 66, there will be a tendency before the bumper 69 to roll away from the landing pit 59 and raise one end of the cushion 63. The plywood member 97 prohibits a rotation of the bumper 69 relative the cushioning member 63 by assuring that the pockets 85 and 91 remain coaxial. Thus, with the landing pit properly anchored either by the augers 101 or straps 105, the entire pit structure 59 and bumper 69 will remain in place during an athletic meet, interconnected by the plywood member 97, the common upper cover member 67, and the fasteners 98.

Referring now to FIG. 6, an alternate means for measuring the location where the athlete lands on the pit 59, used in lieu of the chalk mark method previously described, is shown. In this measurement embodiment, a pair of standards 109 are positioned on the ground of gymnasium surface adjacent the pit 59. These standards, through a pair of uprights 111, support plural light emitters arranged along the length of the pit 59 in a mounting assembly 113. On the opposite side of the pit 59, the uprights 111 support plural photocells 115 arranged along the length of the pit 59 in a mounting assembly 117. Each of the light emitting devices (not shown) within the mounting assembly 113 is aligned with a specific photocell 115 and is separately wired to a monitoring electronic device such that, when the athlete lands on the surface of the pit 59, he will interrupt one or more light beams passing from the element 113 to the element 117. The electronic device is then designed to monitor the light beam closest to the runway 107 which is interrupted by the athlete's feet, this light beam being an accurate measurement of the distance of the athlete's jump. It will be understood that, in this embodiment, the position of the pit 59 is not critical, and therefore alignment marks 119 are placed on each of the standards 109 and are used to align the photo-optical system with corresponding alignment marks 121 on the ground or gymnasium floor. The marks 121 are selected to be a predetermined distance from the toe board used to begin the athlete's jump so that the photocells 115 will be accurately aligned to this toe board and may therefore be used to accurately determine the jump distance.

Figure 7:
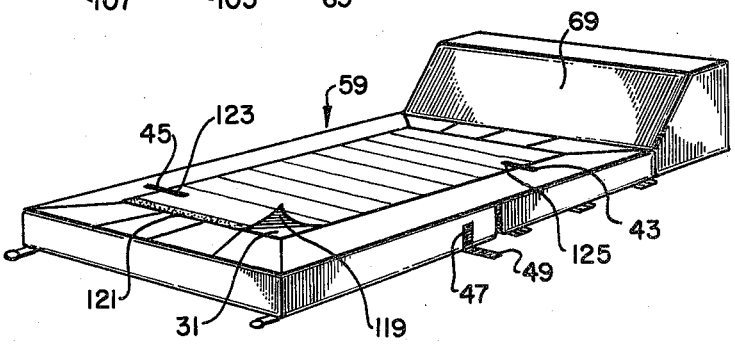
FIG. 7 is a perspective view showing an alternate measurement system using a thin paper sheet which tears upon impact.

An additional, alternate measurement embodiment is shown in FIG. 7. In this embodiment, the alignment marks 47 and 49 on the pit 59 and gymnasium or earth floor are used to align the landing pit with the toe board on the athlete's runway. In addition, a paper or other easily torn sheet 199 is attached, as by a strip of masking tape 121, to the leading edge of the slidable fabric cover 31. Alignment marks 123 and 125 on the paper sheet 119 are accurately aligned with the alignment marks 45 and 43, respectively, on the surface of the landing pit 59. Through the use of these alignment marks, the paper sheet 119 is accurately positioned relative the toe board on the athlete's runway. When the athlete lands on the surface of the paper sheet 119, he will tear this surface at the point where his heals strike the pit 59. Once the alignment marks 47 and 49 have been used to replace the landing pit 59 in its original position, and the alignment marks 123, 125, 43, 45 have been used to replace the paper sheet 119 in its original position, an accurate measurement may be made from the athlete's toe board to the tear in the sheet 119 to determine the distance of the athlete's jump.

Figure 8:
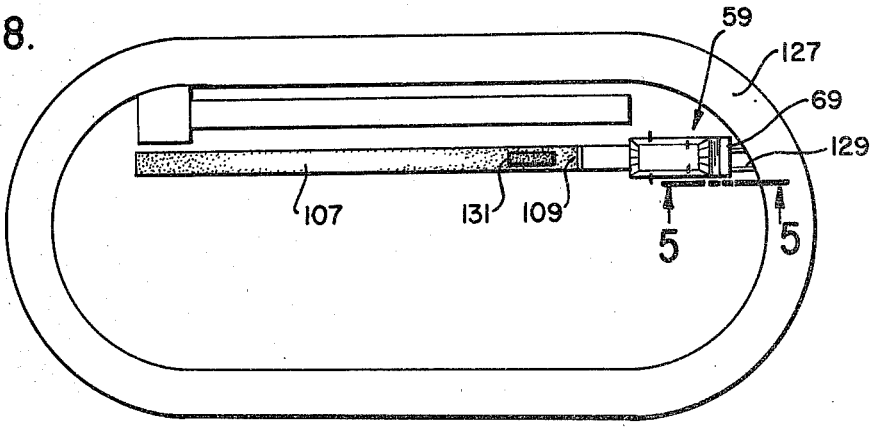
FIG. 8 is a plan view schematically showing the typical location of the landing pits of the present invention within a running track.

When used either indoors or outdoors, the arrangement of the landing pit 59 or the pit 11 of the present invention within the track arena is shown in FIG. 8. An oval track 127 used for other events surrounds the track area. Along one leg of this track 127 and inside of its confines is the elongate raised runway 107 used by long jumpers and triple jumpers to approach the pit 59. The top of this runway 107 is typically covered with artificial turf and, at a predetermined point adjacent the pit 59, a toe board 109 is positioned on the surface of the runway 107 to mark the point where an athlete begins his jump. It will be seen that the pit 59 and bumper 69 are adjacent the track 127, making the bumper 69 extremely important for insuring that jumpers do not enter the track 127 to interfere with other athletic events. A pair of stabilizing members 129 may be used to position the bumper 69 and landing pit 59 relative the track 127. These stabilizing members 129 are additionally shown in FIG. 5 and are positioned against the end of the combined pit 59 and bumper 69. An abutment block 131 may be used at the end of the bumper 69 to absorb shock from the bumper 69 and transmit this shock through the stabilizing members 129 to the track 127.

As shown in FIG. 8, when the chalk marking measurement embodiment described in reference to FIG. 1 is utilized, a chalk box 131 is placed adjacent the end of the runway 107 just short of the toe board 109. This chalk box 131 should be long enough so that the athlete steps in the chalk with each foot prior to his jump. The athlete steps into this chalk box 131 to apply chalk to his track shoes prior to the initiation of a jump.

In summary, there has been described a pair of embodiments 11 and 59 of landing pits, each designed for jumpers whose principal velocity vector is horizontal. These pits, through the use of a specific type of foam material, absorb the lateral momentum of the athlete while protecting him from injury. The athlete is further protected through the use of a sliding upper cover 31 mounted elastically by members 35 which serve to further absorb the athlete's momentum. The bumper 69 provides a surface onto which the athlete can fall on the completion of his jump to protect the athlete and athletes involved in other sporting events. This results in a readily transportable long jump landing pit which requires fewer maintenance operators during a track meet, which protects other athletes from spraying sand and from collisions, and which is easily set up for repeated jumps so that these jumping meets will progress more rapidly than heretofore possible. Furthermore, numerous measurement techniques are disclosed to accurately measure the distance of an athlete's jump. Other elements may be used to heighten spectator interest in these sporting events. Thus, for example, the cover 31 or paper sheet 119 may be imprinted with special marks indicating different jumping records previously set so that spectators can immediately compare a jumper's distance with previous records.

What is claimed is:

1. A landing pit assembly for athletic competition in the long jump, the hop-step and jump, and other events wherein a long jumper is trying to jump a horizontal distance which is much greater than the vertical distance of the jump, said assembly comprising:

elongate, flat, stationary cushioning means, comprising foam material enclosed within a fabric covering, for deforming on impact of said horizontally moving long jumper, the deformation thereby produced moving horizontally within said cushioning means to absorb the horizontal momentum of said jumper;

thin lightweight, horizontally movable sheet means, having a lower surface for sliding on said cushioning means, and an upper surface contiguous with said lower surface for being engaged by said long jumper to permit him to slide horizontally along the top of said cushioning means when he lands thereon, said sheet means being positioned on said cushioning means in a manner which will permit said sheet means to slide easily with said person relative to said cushioning means, thereby imparting a horizontally moving deformation in said cushioning means for controllably absorbing a substantial portion of said long jumper's horizontal momentum in a manner to protect said long jumper from injuries which would result from landing on a landing element that was too hard or too soft, or that slid too easily or not easily enough; and said assembly including means to enable recording of the impact position of the jumper.

2. A landing pit for horizontally moving long jumpers as defined in claim 1 wherein said elongate flat cushioning member comprises plural foam cushioning blocks separately enclosed within plural fabric coverings, said plural fabric coverings attached to a common fabric layer.

3. A landing pit for long jumpers as defined in claim 2 wherein said common fabric layer covers the top of said elongate flat cushioning member.

4. A landing pit for long jumpers as defined in claim 2 wherein said common fabric layer covers the bottom of said flat cushioning member.

5. A landing pit for long jumpers as defined in claim 1 additionally comprising:

means attached to said sheet means for restraining sliding motion of said sheet means relative said cushioning means and thereby partially absorbing the momentum of said long jumper.

6. A landing pit for long jumpers as defined in claim 5 wherein said sheet means has two ends extending generally transverse to the direction of said jumper's horizontal jumping movement, said restraining means comprises plural horizontally extending elastic straps attached between said cushioning member and one end of said sheet means.

7. A landing pit for long jumpers as defined in claim 6 additionally comprising:

plural nonelastic strap members attached between said cushioning member and the other end of said sheet means to facilitate positioning of said sheet means on said cushioning member.

8. A landing pit for long jumpers as defined in claim 1 additionally comprising:

means for anchoring said elongate flat cushioning member to prohibit movement thereof.

9. A landing pit for long jumpers as defined in claim 8 wherein said anchoring means comprises:

an elevated runway adjacent said elongate flat cushioning member; and means attaching said cushioning member to said elevated runway.

10. A landing pit for long jumpers as defined in claim 8 wherein said anchoring means comprises plural earth boring augers attached to said flat cushioning member.

11. A landing pit for long jumpers as defined in claim 8 wherein said anchoring means comprises:

means for bracing said flat cushioning member with respect to an athletic track.

12. A landing pit for long jumpers as defined in claim 1 additionally comprising:

a large foam cushioning element positioned at one end of said flat cushioning member and extending above said flat cushioning member for catching said long jumper after he has landed on said flat cushioning member.

13. A cushion unit for use with a long jump pit as defined in claim 1 for comprising:

a large cushion member positioned at one end of said long jump pit, said cushion member extending above the upper surface of said pit and forming a cushioned barrier to prohibit said athlete from falling past the end of said pit; and fastener means for attaching said cushion member to said one end of said long jump pit.

14. A landing pit for long jumpers, as defined in claim 1, wherein said sheet means comprises:

a lower layer adjacent said cushioning means and that is easily slidable thereon; and an upper layer engaged by said long jumper.

15. The assembly of claim 1 wherein said means to enable recording comprises chalk placed on the feet of said jumper prior to his jump.

16. The asembly of claim 1 wherein said means to enable recording comprises a layer of easily torn material attached to the upper surface of said sheet means.

17. The assembly of claim 1 wherein said means to enable recording comprises a photo electric transmitter and receiver located on opposite sides of said cushioning means for transmitting plural parallel light beams across the surface of said cushioning means in the area of said impact position.

18. The assembly of claim 1 wherein said means to enable recording includes means marked on said sheet means and on said cushioning means to be aligned before and after each jump to insure that the sheet means is properly positioned with respect to said cushioning means.

19. A landing pit assembly for absorbing the momentum of a jumping athlete having a substantial horizontal velocity vector, comprising:

elongate, stationary, soft pad means extending horizontally in the direction of said horizontal velocity vector for deforming on impact of said athlete, the deformation thereby produced moving horizontally within said pad means to absorb the horizontal momemtum of said athlete;

thin lightweight, horizontally movable sheet means, having a lower surface for sliding on the upper surface of said pad means, and an upper surface contiguous with said lower surface for being impacted by said athlete for permitting said athlete to slide on said pad means after landing thereon, said sheet means weighing substantially less than said athlete and being deformable by the impact of said athlete thereon, the deformation thereby produced being stationary relative said sheet means;

the horizontal movement of said sheet means and the deformation therein imparting the horizontal movement to the deformation in said pad means for controllably absorbing a substantial portion of said athlete's horizontal momentum in a manner which closely simulates the momentum-absorbing properties of a loose sand landing pit by protecting said athlete from injuries which would result from landing on a landing element that is too hard or too soft, or that slides too easily or not easily enough; and said assembly including means to enable recording of the impact position of said athlete.

20. A landing pit for absorbing the momentum of a falling jumping athlete as defined in claim 19 additionally comprising:

means attached to said sheet means for restraining the sliding of said sheet means.

21. A landing pit for absorbing the momentum of a jumping athlete as defined in claim 19 wherein said sheet means comprises a thin, lightweight layer positioned on said soft pad means and separate and dissimilar therefrom and slidable relative thereto.

22. A landing pit for absorbing the momentum of a falling athlete as defined in claim 21 wherein said layer comprises two layers, one of which slides easily on said elongate soft pad.

23. A landing pit for absorbing the momentum of a jumping athlete as defined in claim 21 additionally comprising:

plural, horizontally extending, elastic cords attached between said elongate soft pad and said layer.

24. A landing pit for absorbing the momentum of a falling athlete as defined in claim 19 wherein said elongate soft pad comprises a multi-part pad with vertical interstices between said multiple parts, said interstices extending to the top of said pad.

25. A landing pit assembly for absorbing the horizontal and vertical momentum of a long jumper, comprising:

a foam cushion;

thin, lightweight sheet means on said cushion and separate and dissimilar from said cushion for sliding horizontally on impact by said jumper, said sheet means being directly impacted by said jumper;

said foam cushion controllably absorbing energy from said movable sheet means to controllably absorb the horizontal momentum of said long jumper on said impact, said energy absorbing means decelerating said jumper for protecting said long jumper from injuries; and means to enable recording of the impact position of the jumper.

26. A landing pit for absorbing the momentum of a long jumper as defined in claim 25 including:

elastic cords attached to said sheet means for restraining movement of said sheet means.

27. A landing pit for absorbing the momentum of a long jumper as defined in claim 25 additionally comprising:

means for realigning said horizontally movable sheet means subsequent to impact by said long jumper.

28. A landing pit for absorbing the momentum of a long jumper as defined in claim 25 wherein said sheet means comprises:

a fabric layer positioned on top of said cushion and slidable relative thereto.

29. A landing pit assembly for long jumpers and like athletes, comprising:

flat, stationary cushioning means, for deforming on impact of said athlete, the deformation thereby produced moving horizontally within said cushioning means;

thin, lightweight, horizontally movable sheet means, having a lower surface slidably positioned on top of said cushioning means and separate and dissimilar therefrom, and an upper surface for engagement with said athlete, said sheet means being deformable on impact by said athlete, the deformation thereby produced being stationary relative said sheet means;

the horizontal movement of said sheet means and the deformation therein imparting a directly underlying horizontal movement of the deformation in said stationary cushioning means, said movement of said cushioning means deformation absorbing a substantial portion of the horizontal momentum of said athlete; and means to enable recording of the impact position of the athlete.

30. A landing pit for athletic competition in the long jump or other event wherein a long jumper is trying to jump a horizontal distance which is much greater than the vertical distance of the jump, comprising:

large, elongate, flat cushioning for deforming on impact of said horizontally moving jumper to absorb the horizontal momentum of said jumper;

thin lightweight, horizontally movable sheet means having a lower surface for sliding easily on said cushion means, and an upper surface for being engaged by said long jumper to permit him to slide horizontally along the top of said cushioning means when he lands thereon, said sheet means being smaller in area than said cushion means; and elastic means attached to an edge of said sheet means for restraining sliding motion of said sheet means relative said cushion means and thereby partially absorbing the momentum of said long jumper.

* * * * *